United States Patent [19]

Laske et al.

[11] 4,408,643

[45] Oct. 11, 1983

[54] PLASTIC BAGS HAVING A PRESSURE RESISTANT CLOSURE

[75] Inventors: Louis L. Laske, Grayslake; Donald R. Harreld, Antioch, both of Ill.

[73] Assignee: Vonco Products, Inc., Lake Villa, Ill.

[21] Appl. No.: 232,139

[22] Filed: Feb. 6, 1981

[51] Int. Cl.[3] ..... B65D 33/16; B65D 33/24

[52] U.S. Cl. ..... 383/70; 383/61; 383/82; 383/89; 383/87

[58] Field of Search ..... 150/1, 3, 6, 7, 2.1, 150/2.2, 21, 22; 206/260; 128/258, DIG. 24; 229/62; 604/291

[56] References Cited

U.S. PATENT DOCUMENTS

| | | | |
|---|---|---|---|
| 2,036,687 | 4/1936 | Fisher | 150/3 |
| 2,043,924 | 6/1936 | Cowley | 150/3 X |
| 2,150,985 | 3/1939 | Plummer, Jr. | 150/3 |
| 2,294,848 | 9/1942 | Moore | 229/62 |
| 2,342,406 | 2/1944 | Latta et al. | 150/7 |
| 2,709,467 | 5/1955 | Hoeppner | 229/62 X |
| 3,208,587 | 9/1965 | Lizio | 229/62 X |
| 3,299,927 | 1/1967 | Clarizio | 150/2.2 |
| 3,334,805 | 8/1967 | Halbach | 229/62 |
| 3,437,117 | 4/1969 | Vitello et al. | 150/3 |
| 3,655,118 | 4/1972 | Rinecker | 150/3 X |
| 3,720,367 | 3/1973 | Rayner et al. | 150/7 X |
| 3,960,314 | 6/1976 | Faiers | 150/7 X |

FOREIGN PATENT DOCUMENTS

| | | | |
|---|---|---|---|
| 263997 | 11/1963 | Australia | 229/62 |
| 1067391 | 5/1967 | United Kingdom | 229/62 |
| 1331643 | 9/1973 | United Kingdom | 150/7 |
| 1546419 | 5/1979 | United Kingdom | 150/7 |

*Primary Examiner*—William Price
*Assistant Examiner*—Sue A. Weaver
*Attorney, Agent, or Firm*—Thomas W. Speckman

[57] ABSTRACT

Flexible plastic bags having a closure capable of withstanding external force applied to the bag. The bag has a top opening which may be easily opened and closed by a closure member secured to the exterior of the bag forming a pocket having an opening. The pocket opening extends across a portion of the bag substantially parallel to and spaced from the open end. The open end may be folded over upon itself at least two times or twisted upon itself at least three times and the pocket turned inside out over the end portion to form a closure which is resistant to external forces. The bag of this invention is especially suitable for retaining liquids and gases when an external pressure is applied to the bag.

29 Claims, 15 Drawing Figures

PLASTIC BAGS HAVING A PRESSURE RESISTANT CLOSURE

BACKGROUND OF THE INVENTION

This invention relates to plastic bags capable of withstanding external force applied to the bag, and more particularly to plastic bags which have an open end which may be folded over upon itself, and a pocket which may be turned inside out and over the folded open end providing a pressure resistant closure. Such bags are suitable for a wide variety of uses such as medical ice pouches.

A variety of plastic bags have been developed which hold gases, liquids or solids. Two sheets of plastic may be sealed together, or a single sheet may be folded over itself to form two sheets and sealed together to form an enclosure which withstands both the internal forces of the bag contents and external forces which may be applied to the bag. However, it is desired to provide bags having an open end so that the bag may be filled by the user and later emptied and re-used or the contents may be partially withdrawn and the bag reclosed. Various means have been used to close the open end when the bag is filled, depending upon the contents of the bag and requirements of the particular application. For example, bags similar to those shown in U.S. Pat. No. 2,709,467, Australian Pat. No. 263,997, and British Pat. Nos. 1,546,419 and 1,067,391 may be used to contain solid materials, but do not provide a liquid or gas tight closure. U.S. Pat. No. 2,709,467 describes a closure at the top of a bag body having a flap which folds over the top, not providing a gas or liquid tight closure, for use in shirt bags and the like. Australian Pat. No. 263,997 shows bag closure flaps similar to those in U.S. Pat. No. 2,709,467, which also do not provide a gas or liquid tight closure. British Pat. No. 1,546,419 discloses a coin bag having a flap which covers the mouth of the bag and a reversible pocket which may be folded over the mouth and flap. Coins are retained in the bag but gases and liquids would escape. British Pat. No. 1,067,391 teaches the use of a bag having a panel into which the open end portion of the bag may be inserted. Such bags are suitable for sweaters and the like because they keep their contents clean without gas or liquid tight closure of the bag, and the contents may be removed for examination and replaced in the bag. Such bags are not useful for holding gases or liquids.

A gas or liquid tight closure for plastic bags is disclosed in U.S. Pat. No. 3,299,927, which has a filling neck which may be folded over upon itself and a flexible strap extending beyond the edges of the neck at the top opening. The ends of the strap may be snapped around the folded neck to hold it in place. In another similar embodiment, the snap has been omitted and a stiff strap has been used in place of the flexible strap. The stiff strap may be bent around the folded neck with the fingers, and retains the folded neck portion to some extent. Such bags may be filled with ice or water and used by hospital patients to relieve pain or enhance healing. These bags are not sufficiently resistant to external forces when containing more than $\frac{1}{3}$ of the bag volume of liquid and tests have shown the closure will unwind and all bags opened when between 50 and 65 pounds of external force was applied to bags having a $3\frac{1}{4}$ inch inside neck width.

Bags should withstand at least about 75 pounds of external force to be used safely by medical patients for ice or hot water bags and for other uses. Thus, there is a need for plastic bags which resist relatively substantial external forces without leaking.

Accordingly, an object of this invention is to provide a flexible plastic bag for holding gases, liquids, or solids.

Another object is to provide a flexible plastic bag which securely retains liquids or gases and is capable of withstanding, where needed for the particular applications, external forces of greater than 75 pounds.

Yet another object is to provide a flexible plastic bag having an open end which may be twisted or folded over upon itself, and a pocket which may be turned inside out over the twisted or folded open end to form a closure which is resistant to external forces.

SUMMARY OF THE INVENTION

In accordance with one aspect of this invention, a flexible plastic bag for holding gases, liquids or solids has first and second sheets of plastic secured together to form a bag having an open end. A single sheet of plastic may be folded over to form two sheets. A closure member is secured to the exterior of the bag, forming a pocket having an opening which extends across at least a portion of the bag. The pocket opening is faced away from, substantially parallel to, and spaced from the bag open end and the end of the pocket toward the open end of the bag is closed when the bag open end is folded over or twisted upon itself in preparation for turning the pocket inside out over the folded open end to form the desired closure. The open end of the bag may be folded over upon itself at least two times or twisted around itself at least three times and folded over and the pocket may be turned inside out over the folded open end to form a closure which does not leak and is resistant to substantial external force. The open end may be narrower than the rest of the bag, if desired. Also, one or more stiffener strips may be secured to the open end to provide ease of loading and to provide a guide for folding the open end over upon itself as described above.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings in which.

DESCRIPTION OF THE PREFERRED EMBODIMENTS

Figure 1:
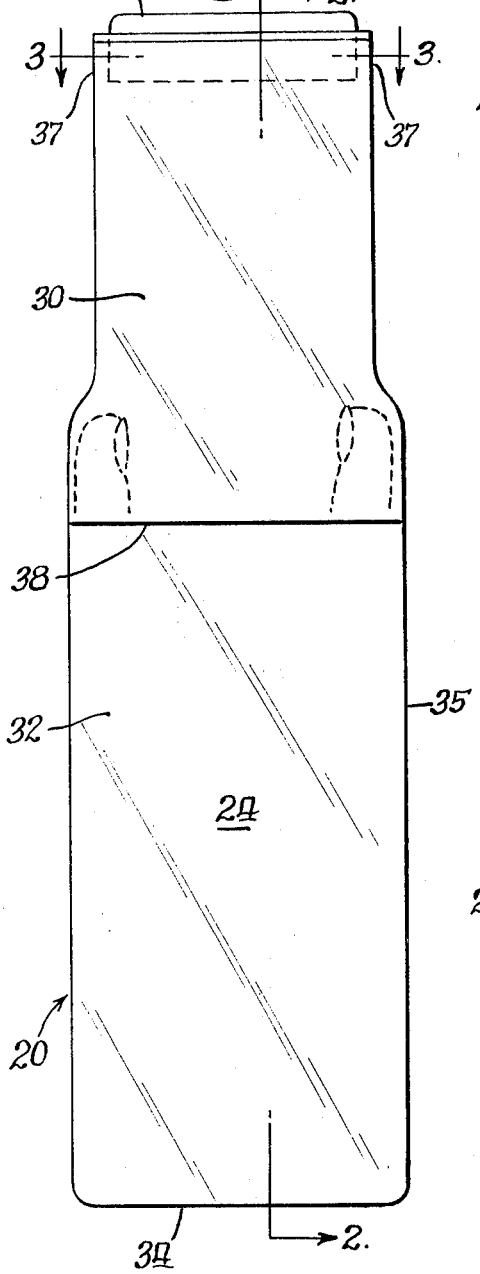
FIG. 1 is a front view of a plastic bag according to one embodiment of this invention.
Figure 2:
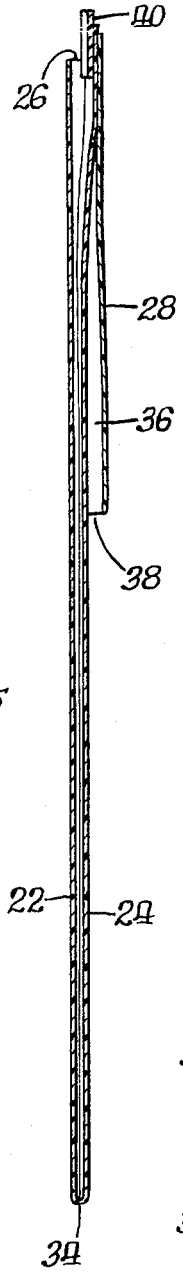
FIG. 2 is a sectional view of the bag of FIG. 1 along line 2—2.

As seen in FIGS. 1 and 2, first plastic sheet 22 and second plastic sheet 24 are secured together to form bag 20 having an open end 26. A single sheet of plastic may be folded over to form first sheet 22 and second sheet 24, if desired. A fold is shown in FIG. 2 as bottom end 34. In such cases, the bag is sealed along or near the side edges 35 to form the bag. The bag may also be formed by using tubular materials and folding so that sheets 22 and 24 become multiple ply. Sheets 22 and 24 may also be multiple webs which can either be sealed or folded to form bottom end 34. For bottom filling it may be desirable to leave end 34 open for loading and then close end 34 providing a reclosable top end according to this invention.

The bag 20 generally includes a bag body 32 and an end portion 30 which extends from the bag body 32 to the open end 26. The width of the end portion may be somewhat less than the width of the bag body 32, as in FIG. 1.

Figure 5:
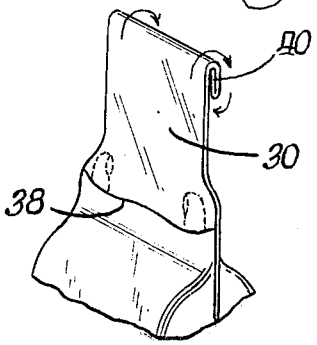
FIG. 5 is a perspective view of a partially closed bag.
Figure 6:
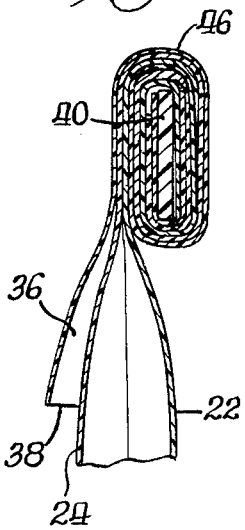
FIG. 6 is a sectional view of the bag of FIG. 1 showing the open end folded several times.
Figure 7:
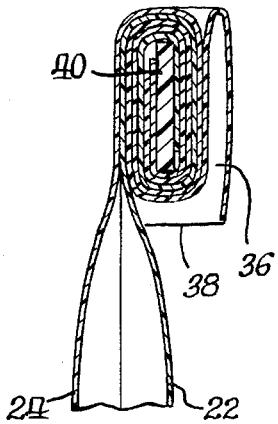
FIG. 7 is a sectional view of the open end of the bag of FIG. 1 showing the pocket turned inside out over the open end.
Figure 8:
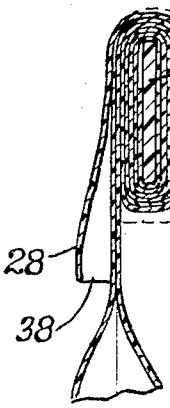
FIG. 8 is a sectional view of the bag of FIG. 1 showing another method of folding the open end.
Figure 10:
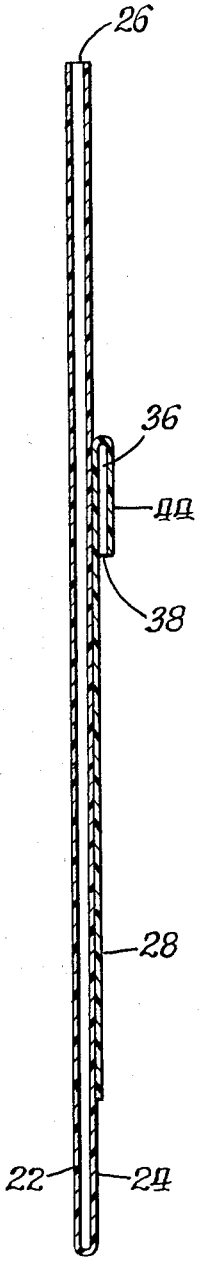
FIG. 10 is a sectional view of the bag of FIG. 9 taken along line 10—10.
Figure 11:
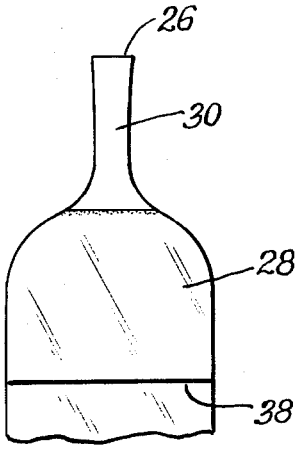
FIG. 11 is a front view of a portion of another embodiment of the bag of this invention.
Figure 10A:
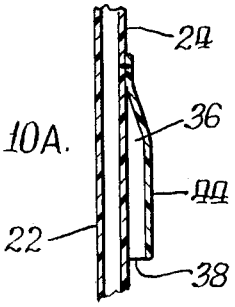
FIG. 10A is a sectional view showing another embodiment of the pocket similar to FIG. 10.
Figure 14:
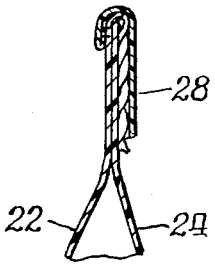
FIG. 14 is a sectional view of the bag of FIG. 13 showing the pocket turned inside out over the twisted neck.

FIG. 1 shows closure member 28 as a sheet covering end portion 30 and being secured to the exterior of second sheet 24 forming a pocket 36 having a pocket opening 38 which faces away from the open end 26. Pocket opening 38 extends across the bag body 32 of bag 20 so that the pocket opening 38 is wider than open end 26, and is substantially parallel to the open end. Pocket opening 38 is spaced from open end 26 so that the open end may be folded over at least two times and pocket 36 may be turned inside out and folded over open end 26, as in FIGS. 5, 6 and 7. Open end 26 should be folded at least two times before the pocket is turned over, although 3 or more rolls is preferred. It is also preferred that the open end 26 be folded until it is somewhat above the pocket opening 38, as seen in FIGS. 6 and 8. Closure member sheet 28 may extend to the top of end portion 30 for the purpose of providing closure instructions thereon or may be only a narrow strip of sufficient width to cover the folded open end when turned inside out. When a narrow strip is used its upper end should be sealed to the sheet forming the bag closing the upper end of pocket 36 as shown in FIG. 10A. When wider strips are used, the upper end need not be so sealed provided folding the open end over upon itself forms such a closed upper end of pocket 36.

Figure 3:
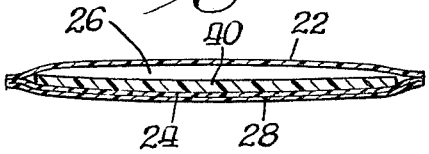
FIG. 3 is a sectional view of the bag of FIG. 1 taken along line 3—3, showing the open end of the bag.
Figure 4:
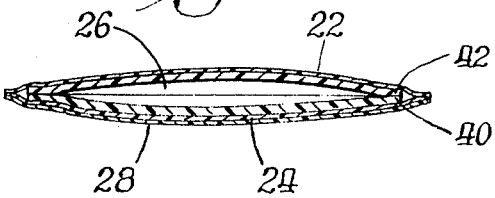
FIG. 4 is a sectional view of another embodiment of the open end of the bag shown in FIG. 1 having two stiffener strips.

A stiffener strip 40 is shown provided in the open end 26 of the embodiment of FIGS. 1 through 3. Strip 40 may be secured to the side edges 37 of open end 26, and/or to either sheet 22 or 24 if strip 40 is narrower than narrow portion 30, as in FIG. 1. Strip 40 may be the full width of the bag or may be any portion of the width of the bag. A second stiffener strip 42 may be provided in open end 26, if desired, so that a stiffener strip is secured to each of the sheets 22, 24 as seen in FIG. 4. The stiffener strip may be on either side of the plastic sheet.

If one or two stiffener strips are included in the bag, the pocket opening 38 should be spaced far enough from the open end 26 so that the bag may be folded at least two and preferably three or more times around the stiffener strips before the pocket is turned inside out over the strip. Although three folds is generally sufficient to form a closure which is resistant to external forces, four or more folds may be used. Strip 40 and strip 42 may be made of relatively stiff plastic, but are flexible enough so that they may be squeezed between the thumb and a finger and bowed to expand open end 26, as seen in FIGS. 3 and 4. This may be useful when filling the bag. The bag opening may be provided with a lip formed by either plastic side sheet or by one of said strips extending beyond the bag side.

Figure 9:
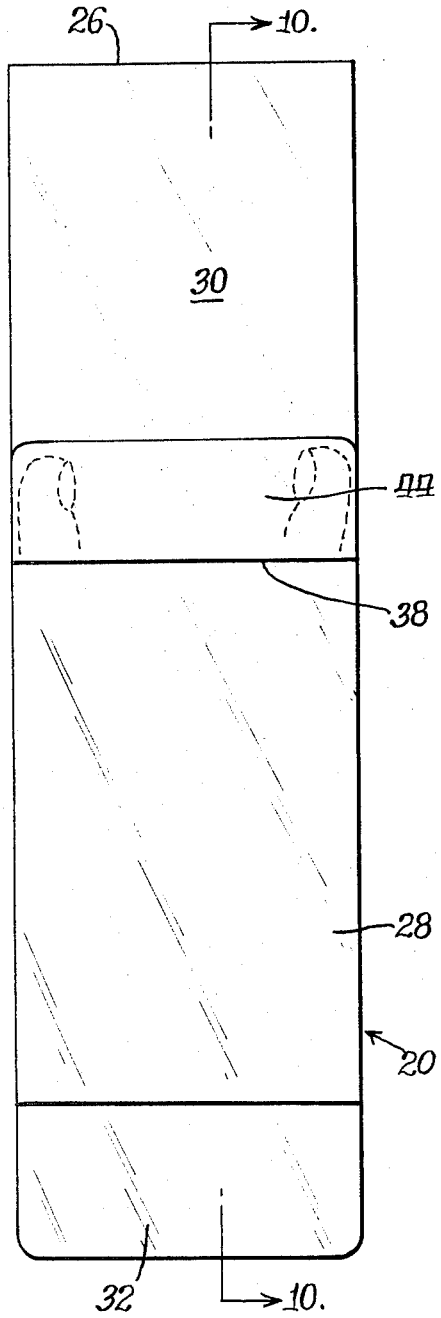
FIG. 9 is a front view of another embodiment of the bag of this invention.

Opening end portion 30 may be the same width as the bag body 32 as seen in FIG. 9, or more greatly necked as shown in the embodiments of FIGS. 11–14. The embodiments shown in FIGS. 11–14 are particularly suited for closure by twisting and enclosing the twisted portion in the pocket in the same manner. The plastic is flexible enough so that pocket 36 may be folded over the edges 37 when the open end 26 is folded over upon itself without damaging the bag.

In the embodiment shown in FIG. 1, closure member 28 is a single piece of plastic which extends toward open end 26 from opening 38. In the embodiment shown in FIGS. 9 and 10, closure member 28 is a plastic sheet which extends along bag body 32 away from end portion 30. A cover portion 44 is formed by folding over the end of member 28 closest to open end 26 and securing the side edges to member 28 to form pocket 36 having pocket opening 38, as seen in FIGS. 9 and 10. Also, cover portion 44 may be a separate sheet of plastic which may be secured to member 28 at the top and in a similar manner secured at the side edges to form pocket 36. In another embodiment cover portion 44 may be a separate sheet of plastic secured to sheet 24 at the top and side to form pocket 36 as shown in FIG. 10A. Pocket opening 38 should be spaced from open end 26 so that open end 26 may be folded over upon itself at least two times and pocket 36 may be turned inside out over the folded open end 26 to form a closure, as in the embodiment of FIG. 7. Closure member 28 may also be a narrower strip of plastic forming a pocket which is not closed at the top so long as the end toward the bag open end is closed when the open end is folded over upon itself in preparation for making the closure by turning the pocket inside out.

The force against the closure of the bag may be reduced in some applications by making the end portion 30 substantially more narrow than the bag body 32, as seen in FIGS. 11 through 14. In such applications, the neck portion 30 and the open end 26 may be twisted several times and folded over behind pocket 36. The pocket 36 may be turned inside out and folded over the twisted open end 26 and narrow portion 30 to form a closure which is resistant to external forces or the open end may be turned over upon itself two or more times as described above and the pocket turned inside out.

In use, the bag 20 may be filled with gas, liquid or solid material. The bag body 32 must be capable of containing the contents of the bag, however, or the user will be unable to properly close open end 26. End portion 30 may be folded over as seen in FIGS. 5 and 6, preferably to a point where the end portion is from slightly below to a substantial distance above pocket opening 38. The user's thumb may be inserted into pocket 36 as shown in FIGS. 1 and 9 while the fingers hold the folded end portion 30. Pocket 36 may then be turned inside out over the folded open end 26 forming a closure as seen in FIG. 7.

FIGS. 5 and 6 show the open end 26 being folded away from the pocket 36. However, open end 26 may also be folded towards pocket 36 several times and folded behind the pocket 26 as shown in FIG. 8. The pocket 36 may then be turned over the folded open end portion as in FIG. 7 to form a closure.

Figure 12:
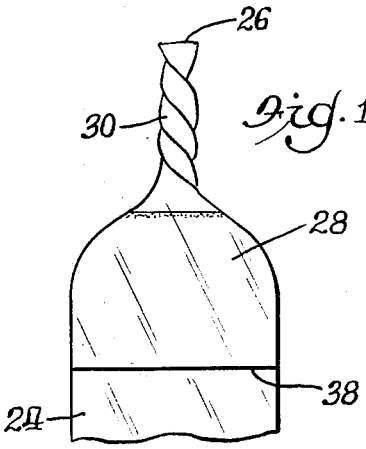
FIG. 12 is another front view of the bag of FIG. 11 showing the open end twisted several times.
Figure 13:
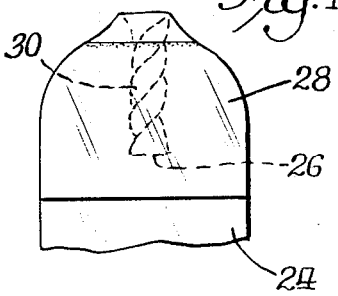
FIG. 13 is another front view of the bag of FIG. 12 showing the twisted open end folded behind the pocket.

In the embodiment shown in FIGS. 11 through 14, open end 26 and narrow end portion 30 may be twisted several times as seen in FIG. 12 and folded behind pocket 36, as in FIG. 13. Pocket 36 may then be turned inside out and folded over the twisted open end 26 and narrow portion 30, as in FIG. 14, forming a closure which is resistant to external forces. Twisting the neck is generally more feasible if the end portion 30 is less than about ½ of the width of the bag body portion 32 and preferably narrower than about 2 inches.

Generally, the width of the bag opening 26 should be less than 8 inches and is preferably about 2 to about 6 inches. Upper end portion 30 must be of sufficient length to permit folding it over upon itself at least twice, the folds being of a width capable of having pocket 36 turned inside out over the folded end. Folds in the order of about ½ to about 2½ inches are suitable.

When used, stiffener strips 40 or 42 are preferably about ½ to about 2½ inches wide and preferably cover a substantial width of the bag opening. Stiffener strips may be used at the open end of bags which are closed by either folding the end portion over upon itself or by twisting the end portion upon itself. The stiffener strips provide ease of loading, ease of folding, and a closure which provides greater resistance to failure due to external forces applied to wider opening bags.

Tests have shown that bags according to this invention filled with water to about 80 percent capacity of the bag and with end portions 2 inches or less in width and closed by folding over a twisting 3 or more times and having the pocket turned inside out over the folded or twisted end withstand external forces in excess of 100 pounds. These tests have been performed with the same results as bags with and without stiffeners.

Bags according to this invention having a pocket width of 5 inches and straight 4½ inch open ends without stiffeners similarly filled to about 80 percent capacity with water withstand about 50 pounds external force; and the same bag with one or two stiffeners withstands about 80 pounds external force.

Bags according to this invention having a pocket width of 8 inches and straight open end of 7½ inches with one or more stiffeners withstood about 40 pounds external force.

Contrary to bag closures of the prior art, such as exemplified by U.S. Pat. No. 3,299,927 discussed above, the closures provided by this invention tighten and become more firmly closed by application of external forces less than required for failure. This is due to the forces within the bag tending to make pocket 36 narrower and smaller, thereby applying more force to the folded over or twisted end portion contained within the pocket. It should also be noted that when the bag body contains a gas or liquid the externally applied force is transmitted against the closure as an internal force, while when the bag body contains a solid, such as a powder, the external forces are not transmitted against the closure as an internal force. For this reason, a bag to hold a powder will contain the powder entirely satisfactorily with only two folds of the end portion while a bag to hold a gas or liquid may require three to five folds to satisfactorily withstand external forces of desired magnitudes. The closure of this invention allows filling the bags to 75 percent and higher of their maximum capacity and obtaining desired external force resistant closures.

The term "bag" as used in this disclosure and the appended claims includes bags of any shape or contour and includes bags which may have auxiliary attachments, such as dispensing attachments in the bottom portions. One application for the flexible plastic bags of this invention which are capable of withstanding external forces applied to the bag is its use as a mixing container into which several components may be readily loaded through the wide top opening, then the top opening closed and the contents thoroughly mixed by hand kneading action. When adequately mixed, such as for decorative frostings and the like, the contents may be dispensed through a nozzle or dispensing attachment at the bottom of the bag.

By terminology "plastic bags" as used throughout this disclosure and the appended claims, we mean any suitable flexible sheet plastic material such as polyethylene, polypropylene, co-extrusions or laminates with paper or metallic materials providing barrier characteristics for particular products. For example, granular fertilizer bags fabricated from polyethylene-paper laminates may be manufactured according to this invention and provide tight closure after use of only a portion of the contents.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A flexible plastic bag for holding gas, liquid, or solid contents and capable of withstanding external forces applied to the bag comprising:

first and second sheets of plastic secured together to form a bag having a body portion for said contents and an open end in an end portion, said open end comprising a stiffener strip secured to one of said sheets;

a closure member secured to the exterior of said bag forming a pocket having an opening facing away from said bag open end, said pocket opening extending across at least a portion of said bag substantially parallel to and spaced from said open end far enough so that said end portion may be folded over said stiffener strip upon itself from said open end at least two times; and said pocket being capable of being turned inside out over said end portion folded over said stiffener strip, the end of the pocket toward said bag open end being closed when said end portion is in condition for said pocket being turned inside out.

2. The bag of claim 1 wherein said end portion is narrower than said body portion and said pocket opening spans said bag in an area where said bag is wider than said open end.

3. The bag of claim 1 wherein said pocket opening is spaced far enough from said open end so that said end portion may be folded at least three times over said stiffener strip and said pocket may be turned inside out over said end portion folded over said stiffener strip.

4. The bag of claim 3 wherein said stiffener strip is narrower than said open end.

5. The bag of claim 3 wherein said open end comprises a second stiffener strip secured to the other sheet of said bag.

6. The bag of claim 5 wherein said stiffener strips are narrower than said open end.

7. The bag of claim 1 wherein said end portion is about the same width as said body portion.

8. The bag of claim 1 wherein said closure member comprises a plastic sheet secured to said bag, and a cover portion which covers part of said sheet to form said pocket.

9. The bag of claim 1 wherein said closure member is a single piece of plastic, and said pocket is formed between said closure member and one of said plastic sheets.

10. The bag of claim 1 wherein the width of said open end is less than about 8 inches.

11. The bag of claim 10 wherein the width of said open end is about 2 to about 6 inches.

12. The bag of claim 1 wherein each fold of said open end is about $\frac{1}{2}$ to about $2\frac{1}{2}$ inches wide, and said pocket opening is spaced about 3 inches to about 15 inches from said open end.

13. The bag of claim 1 wherein the width of said open end portion is less than about 2 inches.

14. A flexible plastic bag holding gas, liquid, or solid contents and capable of withstanding external forces applied to the bag comprising:

first and second sheets of plastic secured together to form a bag having a body portion for said contents and an open end in a narrow end portion;

a closure member secured to the exterior of said bag forming a pocket having an opening facing away from said bag open end, said pocket opening extending across at least a portion of said bag substantially parallel to and spaced from said open end;

said narrow end portion having a width of less than about one-half the width of said body portion enabling said narrow end portion to be twisted upon itself at least three times; and said pocket being capable of being turned inside out over said twisted open end, the end of the pocket toward said bag open end being closed when said end portion is in condition for said pocket being turned inside out.

15. The bag of claim 14 wherein said pocket opening spans said bag in an area where said bag is wider than said open end.

16. The bag of claim 14 wherein said open end comprises a stiffener strip secured to one sheet of said bag.

17. The bag of claim 16 wherein said stiffener strip is narrower than said open end.

18. The bag of claim 16 wherein said open end comprises a second stiffener strip secured to the other sheet of said bag.

19. The bag of claim 18 wherein said stiffener strips are narrower than said open end.

20. The bag of claim 14 wherein said closure member comprises a plastic sheet secured to said bag, and a cover portion which covers part of said sheet to form said pocket.

21. The bag of claim 14 wherein said closure member is a single piece of plastic, and said pocket is formed between said closure member and one of said plastic sheets.

22. The bag of claim 14 wherein the width of said open end is less than about 8 inches.

23. The bag of claim 22 wherein the width of said open end is about 2 to about 6 inches.

24. The bag of claim 14 wherein the width of said open end portion is less than about 2 inches.

25. A method of closing a flexible bag for holding gas, liquid, or solid contents of a type capable of withstanding external forces applied to the bag and comprising first and second sheets of plastic secured together to form a bag having a body portion for said contents and an open end in an end portion, a closure member secured to the exterior of said bag forming a pocket having an opening facing away from said bag open end, said pocket opening extending across at least a portion of said bag substantially parallel to and spaced from said open end, said method comprising the steps:

folding said end portion over upon itself from said open end at least two times; and turning said pocket inside out over said folded open end, the end of the pocket toward said bag open end being closed when said end portion is in condition for said pocket being turned inside out.

26. The method of claim 25 comprising the step of folding said end portion over upon itself at least three times away from said pocket.

27. The method of claim 25 comprising the step of folding said end portion over upon itself at least three times toward said pocket, then folding said folded end portion away from said pocket opening at least once, and then turning said pocket inside out and over said folded end portion.

28. The bag of claim 1 in the closed position with said end portion folded over upon itself from said open end at least two times and said pocket turned inside out over said folded open end, the end of the pocket toward said bag open end being closed.

29. The bag of claim 14 in the closed position with said end portion twisted upon itself at least three times and said pocket turned inside out over said twisted open end, the end of the pocket toward said bag open end being closed.

* * * * *